US009622549B2

(12) United States Patent
Brigato

(10) Patent No.: US 9,622,549 B2
(45) Date of Patent: Apr. 18, 2017

(54) PRESS STUD WITH AN ANTI-UNCOUPLING SYSTEM

(71) Applicant: Renato Brigato, Bovolenta (IT)

(72) Inventor: Renato Brigato, Bovolenta (IT)

(73) Assignee: RIRI S.A., Mendrisio (CH)

( * ) Notice: Subject to any disclaimer, the term of this patent is extended or adjusted under 35 U.S.C. 154(b) by 159 days.

(21) Appl. No.: 14/327,081

(22) Filed: Jul. 9, 2014

(65) Prior Publication Data

US 2015/0033507 A1 Feb. 5, 2015

(30) Foreign Application Priority Data

Aug. 2, 2013 (EP) ..... 13179168

(51) Int. Cl.
*A44B 17/00* (2006.01)
*A44B 1/44* (2006.01)

(52) U.S. Cl.
CPC ..... *A44B 17/0041* (2013.01); *A44B 1/44* (2013.01); *A44B 17/007* (2013.01); *A44B 17/0011* (2013.01); *A44B 17/0052* (2013.01); *A44B 17/0076* (2013.01); *A44B 17/0064* (2013.01); *Y10T 24/3613* (2015.01); *Y10T 24/45775* (2015.01)

(58) Field of Classification Search
CPC ..... A44B 17/0064; A44B 17/0052; A44B 17/0005; A44B 17/00; A44B 17/0017; A44B 17/0076; A44B 17/007; A44B 17/0011; A44B 17/0041; A44B 1/44; Y10T 24/45775; Y10T 24/3613
See application file for complete search history.

(56) References Cited

U.S. PATENT DOCUMENTS

RE22,625 E * 4/1945 Huelster ..... A44B 17/0011 24/674
4,719,674 A * 1/1988 Kit ..... A44B 17/0011 24/108
2007/0193006 A1* 8/2007 Kitano ..... A44B 17/0011 24/323

(Continued)

FOREIGN PATENT DOCUMENTS

EP 1 027 838 A1 8/2000
GB 223 251 10/1924

(Continued)

OTHER PUBLICATIONS

European Search Report issued in Appln. No. 13179168.3 dated Dec. 13, 2013 (7 pages).

*Primary Examiner* — Robert J Sandy
*Assistant Examiner* — Michael Lee
(74) *Attorney, Agent, or Firm* — Flynn, Thiel, Boutell & Tanis, P.C.

(57) ABSTRACT

A press stud comprises a male element and a female element, which show, when coupled, a capacity for mutual transverse displacement with respect to the coupling direction to move, when subjected to tension acting in a substantially transverse direction with respect to the coupling direction, from an uncouplable position to a locked position. An elastic centring member exerts an elastic force on the male element and/or on the female element to keep them in the uncouplable position in the absence of tension acting in a substantially transverse direction with respect to the coupling direction.

9 Claims, 4 Drawing Sheets

(56) References Cited

U.S. PATENT DOCUMENTS

| | | | | |
|---|---|---|---|---|
| 2011/0041295 | A1 | 2/2011 | Reiter | |
| 2014/0137373 | A1* | 5/2014 | Villa | A44B 17/0023<br>24/108 |

FOREIGN PATENT DOCUMENTS

| | | | |
|---|---|---|---|
| GB | 565 289 | | 4/1943 |
| GB | 581 096 | | 8/1944 |
| GB | 692 294 | | 10/1950 |
| WO | WO 94/19979 | A1 | 9/1994 |
| WO | WO 97/15207 | A1 | 5/1997 |
| WO | WO 2004/066766 | A1 | 8/2004 |
| WO | WO 2011/118412 | A1 | 9/2011 |
| WO | WO 2012/159974 | A1 | 11/2012 |
| WO | WO 2013/008340 | A1 | 1/2013 |

* cited by examiner

PRESS STUD WITH AN ANTI-UNCOUPLING SYSTEM

The present invention relates to the field of press studs. The invention has been developed with particular regard to a press stud with an anti-uncoupling system, which prevents the unfastening of the stud when it is subjected to transverse traction.

Press studs are generally known, and comprise, in each case, a female element and a male element which can be coupled together in an uncouplable way by means of an elastically deformable engagement member mounted in the female element. The engagement member is normally ring-shaped and is mounted in a housing seat of the female element. At least a portion of the male element can be selectively inserted into the housing seat in a coupling direction, to move from an unfastened configuration, in which the male element and the female element are separate and uncoupled, to a fastened configuration in which the two male and female elements are coupled together. A stud of this type is known from WO 1997/15207.

There are various known press studs of the aforementioned type, which are fastened and unfastened by exerting pressure or traction, respectively, on the two male and female elements in the coupling direction. In some applications, when the press studs are in the fastened configuration, they must also withstand lateral traction forces, in other words forces acting in a transverse direction with respect to the coupling direction, without becoming unfastened. A typical, but non-limiting, example is that of press studs used for fastening the belts of trousers. A known solution for preventing the unfastening of press studs subjected to lateral traction forces is that of stiffening the elastic engagement member, so that it exerts a greater grip on the portion of the male element inserted into the housing seat of the female element. This increases the degree of force that has to be applied in order to deform the engagement member and thereby unfasten the press stud. However, it also increases the difficulty of intentionally fastening and unfastening the press stud, since more force has to be exerted on the two male and female elements to overcome the elastic constraint of the elastic engagement member. In other words, a press stud of this type is "stiffer", and is often not well received by users.

WO 2004/066766 illustrates a magnetic stud which has two elements coupled magnetically, and which comprises a protection system which prevents the relative lateral displacement of the two elements in their coupled configuration. This magnetic stud comprises engagement means which interact so as to resist the disengagement of the two elements when they are magnetically coupled and are simultaneously subjected to lateral tension applied transversely to the direction of magnetic coupling. However, this magnetic stud is less effective in terms of security of fastening, since the magnetic coupling force is rather weak and cannot be easily adjusted according to the requirements of application. Furthermore, this magnetic stud is rather bulky, since the engagement means comprise an additional annular bowl-like body which increases the overall radial dimensions of one of the two magnetic elements. One of the two magnetic elements also has an annular disc-like plate projecting from the head of the magnetic element in the proximity of its magnetic engagement face. This is impractical, or even harmful, because of the risk that the magnetic element will become entangled, in the garment or in other objects for example, when the magnetic stud is unfastened.

WO 2012/159974 illustrates a press stud in which the male element and the female element resist disengagement when they are fastened and when they are simultaneously subjected to lateral tension applied transversely to the coupling direction. In this press stud, the anti-uncoupling solution is similar to that of the magnetic stud of WO 2004/066766, since an outer annular bowl-like body is provided on the male element, the female element being inserted into this body with a coupling portion of the male element being inserted, in turn, into the female element. When the two elements are subjected to lateral tension, the female element is translated within the bowl-like body of the male element, so as to prevent the detachment of the two elements in the coupling direction. As in the case of the magnetic stud of WO 2004/066766, this anti-uncoupling system is again very bulky because of the presence of the outer annular bowl-like body, making the system wholly unsuitable for press studs of limited size. Furthermore, the press stud illustrated in WO 2012/159974 requires very small tolerances in order for the anti-uncoupling system to operate correctly, with the disadvantage that the two male and female elements have to be virtually perfectly aligned in order to unfasten them intentionally, and this may prove to be impractical, inconvenient and problematic.

There are also known press studs with lateral closure such as that described in EP 1027838 held by the present applicant, in in which the female component has a housing seat for a mushroom-shaped protrusion of a male component. The seat can be accessed through a shaped opening having a first, larger, portion, which allows the insertion of the head of the mushroom-shaped protrusion, and a second, smaller, portion, into which the stem of the mushroom-shaped protrusion is laterally snap-fitted, and in which the protrusion is retained by elastic means. In order to release the stud, lateral tension must be applied so as to push the mushroom-shaped head towards the larger portion of the shaped opening, while this movement is opposed by the elastic means. The stud is therefore less suitable for use in garments such as trousers, since, in order to fasten and unfasten the stud, tension must be applied between the two components, resulting in the momentary tightening of the garment, which may be troublesome. Although the stud described in EP 1027838 has proved to be effective in many applications, it has been considered necessary to improve it.

The object of the present invention is to overcome the problems of the prior art, and in particular to reduce the risk of accidental unfastening of a press stud while ensuring that the operations of intentionally fastening and unfastening the press stud remain convenient and straightforward. A further object is to provide a press stud having reduced dimensions which is easily and economically manufactured, with the least possible modification of the production processes and the geometries of conventional types of press stud. A further object is to provide a press stud which is reliable and simple in use, and which preferably does not give rise to any particular risk of entanglement in garments or other objects, especially when unfastened.

In order to achieve the above objects, the present invention proposes a press stud having the features disclosed in the claims below.

Further characteristics and advantages of the invention will be made clear by the following detailed description of a preferred embodiment of the invention, which refers to the attached drawings provided purely by way of non-limiting example, in which.

Figure 1:
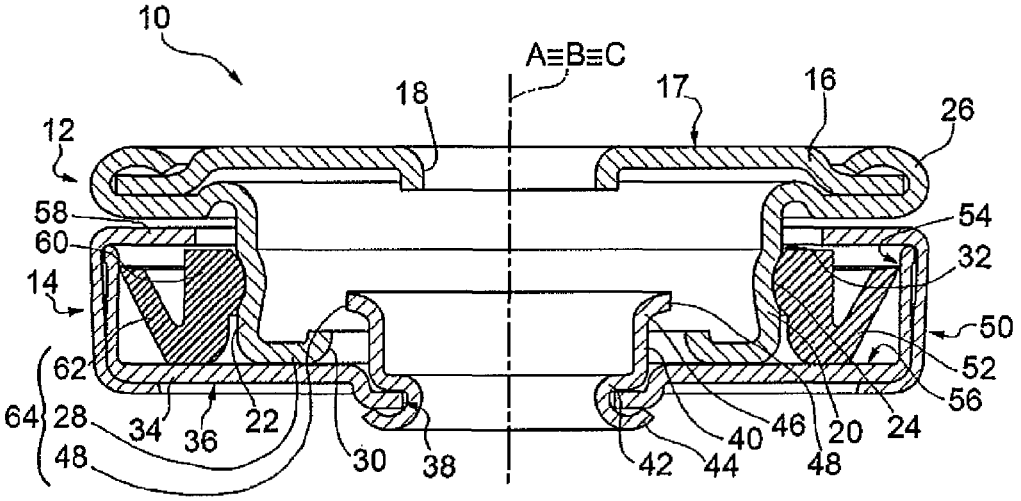
FIG. 1 shows, in cross section, a first embodiment of a press stud according to the present invention, in a disengageable fastened configuration.
Figure 2:
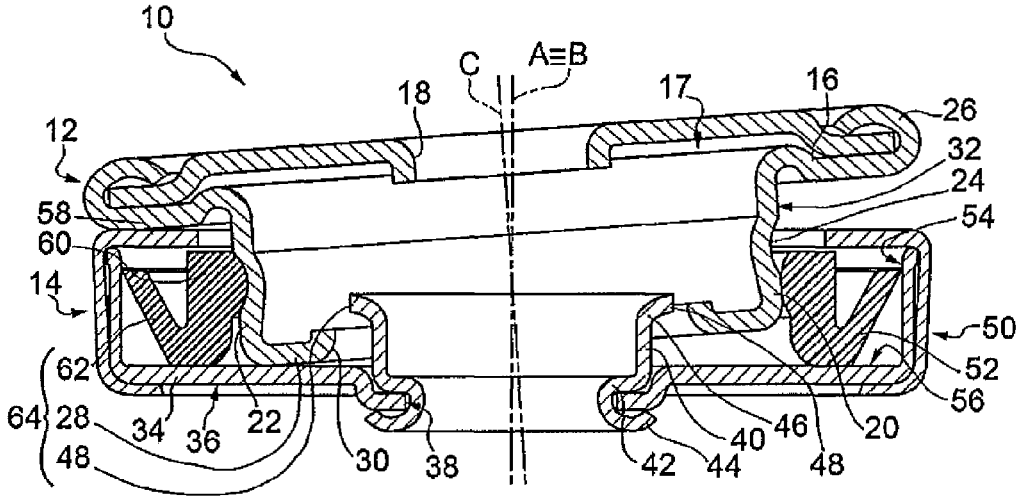
FIG. 2 shows, in cross section, the press stud of FIG. 1 during an operation of intentional unfastening from the fastened configuration of FIG. 1.

With reference now to FIGS. 1 to 4, a press stud 10 according to a first embodiment comprises a male element 12 and a female element 14, which, in use, are fixed to two respective substrates such as flaps of fabric, leather, plastic or other material, to enable them to be fastened together. The male and female elements can be fixed to the two respective substrates in ways which are known and which, therefore, are not described in detail, such as riveting, pinning, stitching and other methods generally known in the field.

The male element 12 comprises a substantially flat disc-shaped base 16, with a face 17 intended to bear on the substrate when in use. The base 16 preferably has a central hole 18 for the passage, for example, of a member (not shown) for fixing to the substrate, for example a rivet or the like.

A coupling portion 20, intended to couple the male element 12 to the female element 14, protrudes from the base 16 of the male element 12. The coupling portion 20 comprises a substantially tubular body 22 with an end flange fixed to the outer edge of the base 16 by means of a bent-back part 26 in such a way that the tubular body 22 protrudes on the opposite side of the disc-shaped base 16 from the face 17. At the opposite end, the tubular body 22 has a smooth head which terminates in an annular bent-back part 28 directed towards the inner cavity, acting as an anti-uncoupling appendage, with an inner annular edge 30. On its lateral wall 32, the tubular body 22 has a neck 24 formed by an annular groove or depression, the diameter of which is smaller than that of the head.

The female element 14 comprises a substantially flat base 34, with a face 36 intended to bear on the substrate in use, from which there extends a housing seat 54 for the coupling portion 20 of the male element 12. The base 34 has a central hole 38 into which is inserted a tubular body 40 with one of its ends 42 bent to form a bent-back part 44 for fixing to the base 34, in such a way that the tubular body 40 protrudes on the opposite side of the base 34 from the face 36. The other end 46 of the tubular body 40 is provided with an annular bent-back part 48 bent towards the outside, forming an annular anti-uncoupling appendage capable of interacting, as described more fully below, with the anti-uncoupling appendage formed by the annular bent-back part 28 of the male element 12, thus forming together with the latter a locking device 64 for locking the press stud of the present invention.

The housing seat 54 of the female element 14 houses an elastic engagement member 50, comprising an elastic ring 52 which can bear on a face 56 of the base 34, opposite the face 36 which bears on the substrate. On the opposite side from the base 34, the housing seat 54 is delimited by an annular retaining edge 58, preferably made from shaped sheet metal, which prevents the elastic ring 52 from moving out of the housing seat 54. The elastic ring 52 comprises an inner portion 60 adapted to grip the neck 24 of the tubular body 22 of the male element 14 after it has been enlarged by its smooth head during the introduction of the coupling portion 20 into the housing seat 54. The elastic ring 52 further comprises an outer lip 62, preferably made in one piece with the inner portion 60 and preferably thinner than the latter and angled with respect thereto, preferably so as to create a substantially V-shaped section in combination with the inner portion. The outer lip 62 has the function of keeping the elastic ring 52 substantially centred in the housing seat 54, in other words with its longitudinal axis A practically coinciding with the longitudinal axis B of the base 34 of the female element 14.

In use, the male element 12 and the female element 14 of the press stud 10 are fixed to two respective substrates which are to be fastened. In order to fasten the press stud 10, the male element 12 is positioned, in a known way, with its longitudinal axis C substantially coinciding with the axis B of the female element 14, this being achieved in practice by making the head of the male element 12 bear on the mouth of the housing seat 54 of the female element 14. The two male 12 and female 14 elements are then pressed towards each other in a coupling direction, substantially parallel to the longitudinal axis B of the female element, with a pressure such that the head of the male element 12 can deform the elastic ring 52 sufficiently to allow its passage, after which passage the elastic ring 52 tightens elastically around the neck of the male element 12 formed by the circular groove 24, thus retaining the coupling portion 20 in the housing seat 54 of the female element in a fastened configuration of the press stud 10.

When the male element 12 and female element 14, coupled to each other in this fastened configuration, are subjected to substantially transverse tension with respect to the coupling direction B, the tubular body 22 is displaced laterally with respect to the centred position in the housing seat 54. As a result of this displacement, the outer lip 62 of the elastic ring 52 is pushed against the inner tubular wall of the housing seat 54, and exerts a corresponding opposing force which tends to return the tubular body 22 to the centred position in the housing seat 54 when the transverse tension ceases. In the laterally displaced position of the tubular body 22, a locked coupled configuration of the press stud is created, since the two anti-uncoupling appendages 28 and 48 of the male element 12 and the female element 14 respectively are positioned in an undercut arrangement with respect to each other, and substantially interfere with each other if an attempt is made to unfasten the press stud.

When the transverse tension on the male element 12 and female element 14 of the press stud 10 ceases, the elastic force of the outer lip 62 of the elastic ring 52 returns the male element 12 and female element 14 to the disengageable coupled position, in which the longitudinal axes A, B and C are again substantially coincident. Thus the two anti-uncoupling appendages 28 and 48 of the male element 12 and the female element 14 respectively, are no longer superimposed on each other in an undercut arrangement. At this point, the two male 12 and female 14 elements can be intentionally uncoupled and separated so as to unfasten the press stud 10, simply by exerting traction so as to move the two male 12 and female 14 elements away from each other in a known way, as in the case of a conventional press stud. The smooth head of the tubular body 22 enlarges the elastic ring 52, thus allowing it to disengage from the coupling portion 20 of the male element 12.

Figure 3:
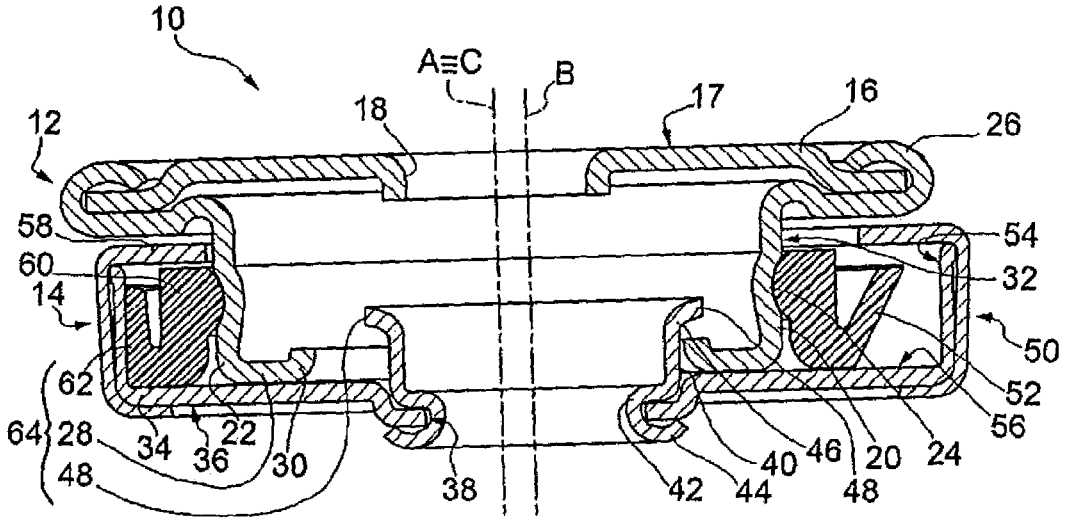
FIG. 3 shows, in cross section, the press stud of FIG. 1 a locked fastened configuration, in which the press stud is subjected to lateral tension.
Figure 4:
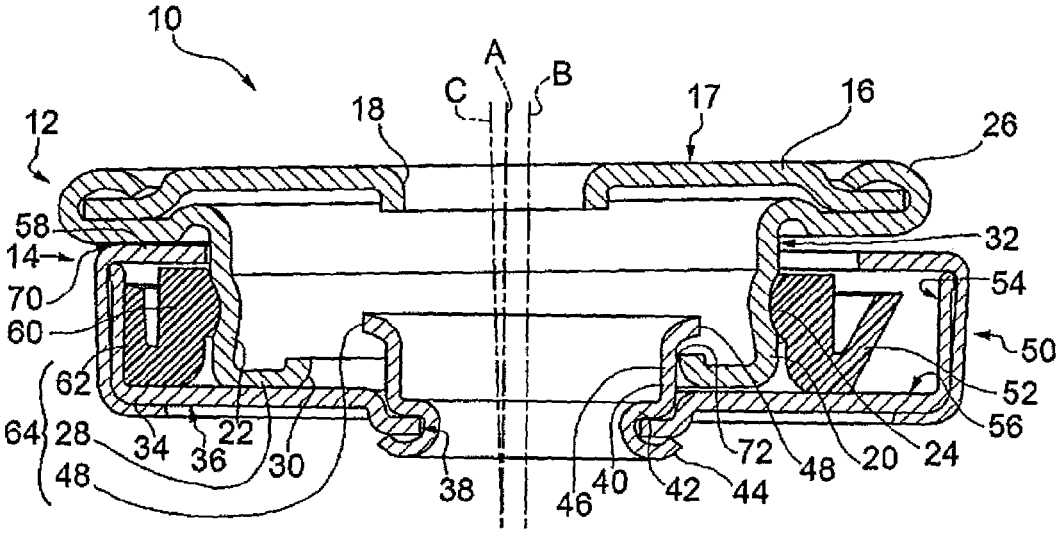
FIG. 4 shows, in cross section, the press stud of FIG. 1 in the locked fastened configuration of FIG. 3, when an attempt is made to unfasten it.
Figure 5:
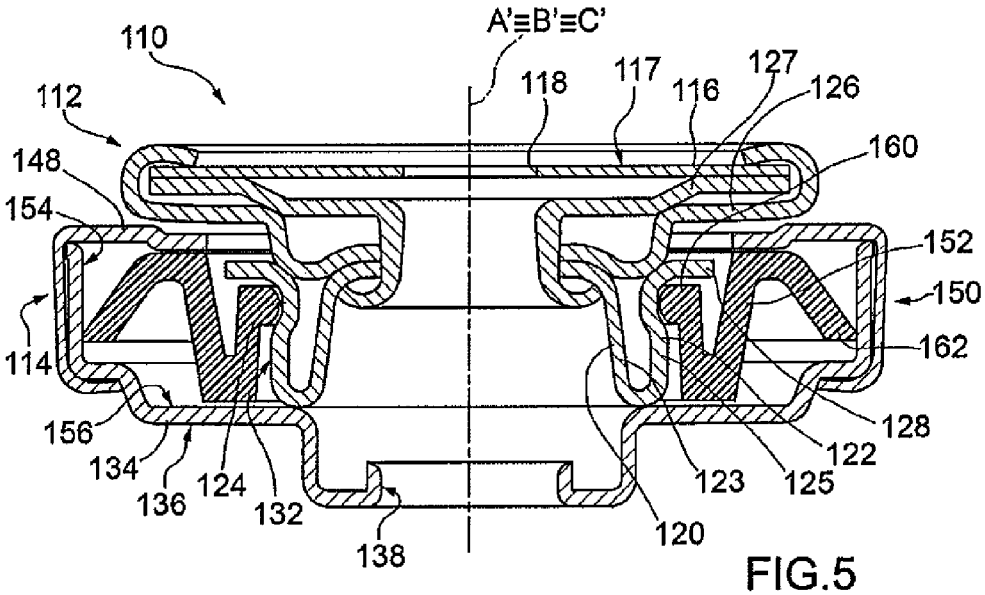
FIG. 5 shows, in cross section, a second embodiment of a press stud according to the present invention, in a disengageable fastened configuration.
Figure 6:
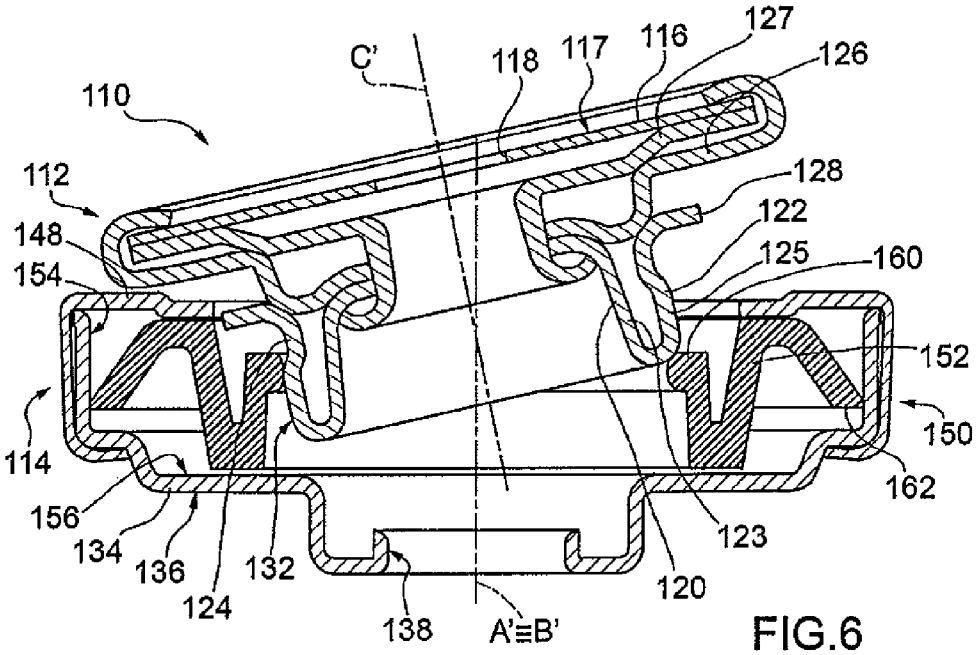
FIG. 6 shows, in cross section, the press stud of FIG. 5 during an operation of intentional unfastening from the fastened configuration of FIG. 5.
Figure 7:
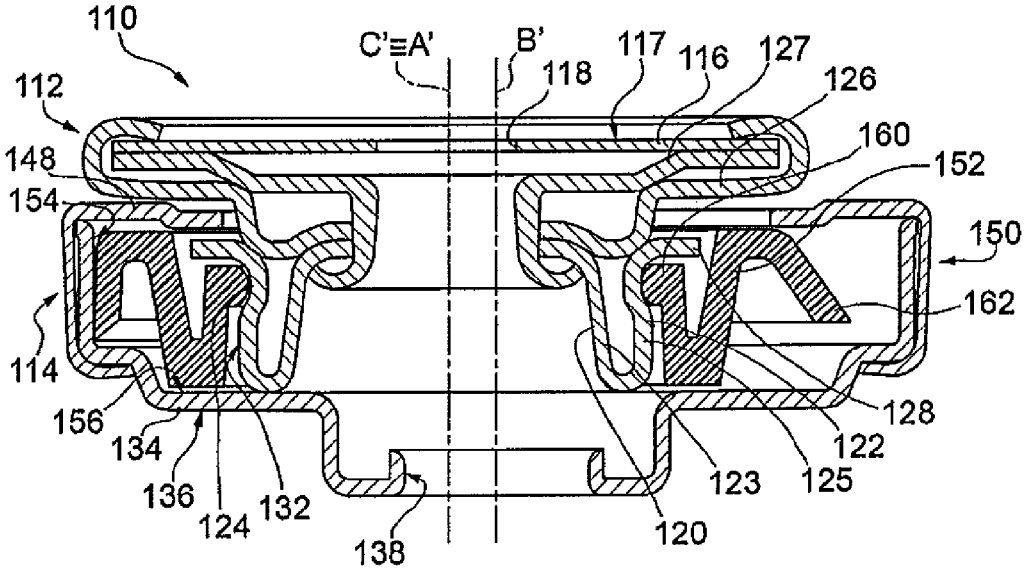
FIG. 7 shows, in cross section, the press stud of FIG. 5 a locked fastened configuration, in which the stud is subjected to lateral tension.
Figure 8:
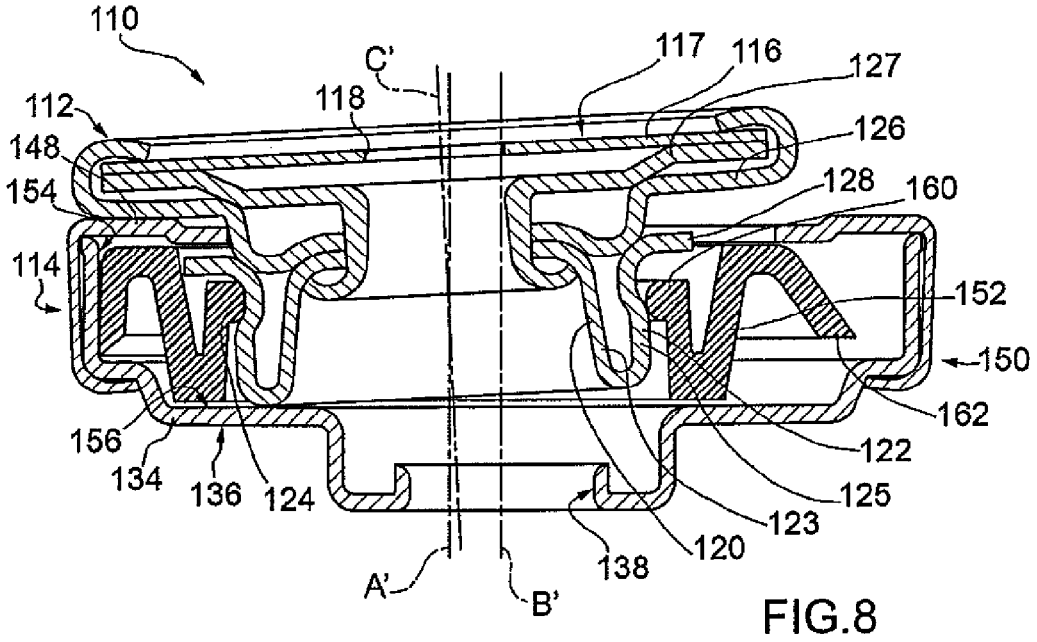
FIG. 8 shows, in cross section, the press stud of FIG. 5 in the locked fastened configuration of FIG. 7, when an attempt is made to unfasten it.

The shape of the anti-uncoupling appendages 28 and 48 of this embodiment is particularly advantageous: when the press stud is in the locked coupled configuration of FIGS. 3 and 4, subjected to tension transverse to the coupling direction B, attempts to unfasten the stud may cause a contact between the male element 12 and the female element 14 at two points of contact 70, 72 which are diametrically opposed, or at least substantially distant from each other with respect to the lateral dimension of the press stud. Thus the lever which prevents the accidental uncoupling of the male element 12 and female element 14 is particularly favourable, such that good anti-uncoupling behaviour is achieved for significant levels of lateral tension, even for press studs of relatively small size.

FIGS. 5 to 8 show a second embodiment of the press stud according to the present invention. This press stud 110 comprises a male element 112 and a female element 114, to be applied, respectively, to two substrates that are to be fastened, in a similar way to the first embodiment.

The male element 112 comprises a substantially flat disc-shaped base 116, with a face 117 intended to bear on the substrate in use. The base 116 preferably has a central hole 118 for the passage, for example, of a member (not shown) for fixing to the substrate, for example a rivet or the like.

A coupling portion 120, intended to couple the male element 112 to the female element 114, protrudes from the base 116 of the male element 112. The coupling portion 120 comprises a substantially tubular body 122, formed by two coaxial tubular structures 123 and 125, forming an inner and an outer structure respectively, and preferably made in one piece, by bending a piece of sheet metal for example. The inner tubular structure 123 is fixed to the base portion 116, by means of a pair of connecting sheets 126 and 127 for example, so that the tubular body 122 protrudes from the opposite side of the base 116 from the face 117. The outer tubular structure 125 terminates in an annular bent-back part 128 bent towards the outside, forming a first anti-uncoupling appendage, positioned near the base 116 of the male element 112. On its lateral wall 132, the outer tubular structure 125 has a neck 124 formed by an annular groove or depression, the diameter of which is smaller than that of an end head of the coupling portion 120.

The female element 114 comprises a substantially flat base 134, with a face 136 intended to bear on the substrate in use, from which there extends a housing seat 154 for the coupling portion 120 of the male element 112. The base 134 preferably has a central hole 138 for the passage, for example, of a member (not shown) for fixing to the substrate, for example a rivet or the like.

The housing seat 154 of the female element 114 houses an elastic engagement member 150, comprising an elastic ring 152 which can bear on a face 156 of the base 134, opposite the face 136 which bears on the substrate. On the opposite side from the base 134, the housing seat 154 is delimited by an annular retaining edge 148, preferably formed from shaped sheet metal, which prevents the elastic ring 152 from moving out of the housing seat 154. The annular retaining edge 148 also acts as an anti-uncoupling appendage 148.

The elastic ring 152 comprises an inner portion 160 adapted to grip the neck 124 of the outer tubular structure 125 of the tubular body 122 of the male element 112, after being enlarged by its smooth head during the introduction of the coupling portion 120 into the housing seat 154. The elastic ring 152 further comprises an outer lip 162, preferably made in one piece with the inner portion 160 and angled with respect thereto, and shaped so as to create a substantially Z-shaped section in combination with the inner portion. The outer lip 162 has the function of keeping the elastic ring 152 aligned in a substantially centred position in the housing seat 154, in a similar way to that described above with reference to the first embodiment of FIGS. 1 to 4, that is to say with its longitudinal axis A' practically coinciding with the longitudinal axis B' of the base 134 of the female element 114.

In use, the coupling and uncoupling behaviour of the male element 112 and female element 114 in the absence of transverse tension does not differ from that of known types of press studs or from what has been described above with reference to the first embodiment of FIGS. 1 to 4.

When the male element 112 and female element 114, coupled to each other in the fastened configuration, are subjected to substantially transverse tension with respect to the coupling direction B', the tubular body 122 is displaced laterally with respect to the centred position in the housing seat 154. As a result of this displacement, the outer lip 162 of the elastic ring 152 is pushed against the inner tubular wall of the housing seat 154, and exerts a corresponding opposing force which tends to return the tubular body 122 to the centred position in the housing seat 154 when the transverse tension ceases. In the laterally displaced position of the tubular body 122, a locked coupled configuration of the press stud is created, since the two anti-uncoupling appendages 128 and 148 of the male element 112 and the female element 114 respectively are positioned in an undercut arrangement with respect to each other, and substantially interfere with each other if an attempt is made to unfasten the press stud. In particular, the edge 148 of the mouth of the housing seat 154 is partially positioned in the space between the annular appendage 128 and the base of the male element 112.

In a similar way to that described above regarding the first embodiment of FIGS. 1 to 4, when the transverse tension on the male element 112 and female element 114 of the press stud 110 ceases, the elastic force of the outer lip 162 of the elastic ring 152 returns the male element 112 and female element 114 to the disengageable coupled position, in which the longitudinal axes A', B' and C' are again substantially coincident. Thus the two anti-uncoupling appendages 128 and 148 of the male element 112 and the female element 114 respectively, are no longer superimposed on each other in an undercut arrangement. At this point, the two male 112 and female 114 elements can be intentionally uncoupled and separated so as to unfasten the press stud 110, simply by exerting traction so as to move the two male 112 and female 114 elements away from each other in a known way, as in the case of conventional press studs. The smooth head of the tubular body 122 enlarges the elastic ring 152, thus allowing it to disengage from the coupling portion 120 of the male element 112.

In the illustrated embodiments, the components of the press stud are made of shaped sheet metal, with the exception of the elastic ring 52, 152, which is made of plastic material. Clearly, provision may be made to make some or all of the male and female elements of the stud in a different way, by forming for example, and from wholly or partially different materials, for example by using plastic materials or metal castings, and also, for example, by making the elastic ring of metal. The centring of the elastic ring can also be achieved in a different way from that described and illustrated, for example by providing a supplementary elastic member, separate from the elastic ring, acting on the latter to keep it in a centred position, and to return it to this position on the cessation of the lateral tension whose effects on the press stud of the present invention are described above.

The press stud of the present invention is particularly compact in terms of its lateral dimension, and can therefore replace known press studs for all purposes. The production process is also particularly simple and does not require radical modification of the production methods for press studs of known types.

Clearly, provided that the principle of the invention is retained, the forms of embodiment and the details of construction can be varied widely from what has been described and illustrated, without departure from the scope of the invention.

The invention claimed is:

1. A press stud comprising a male element and a female element, the male element comprising a coupling portion insertable into a housing seat of the female element in a coupling direction to provide an uncouplable coupling of the male element with the female element, an elastic engagement member mounted in the female element and engaging in a disengageable way the coupling portion of the male element when the coupling portion is inserted into the housing seat of the female element in the coupling direction, the male element and the female element showing, when coupled, a capacity for mutual transverse displacement with respect to the coupling direction to move, when subjected to tension acting in a substantially transverse direction with respect to the coupling direction, from an uncouplable coupled position to a locked coupled position in which the male element interferes with the female element, thereby preventing an uncoupling action and detachment of the male element from the female element, and an elastic centring member exerting an elastic force on the male element and/or on the female element to keep the male element and the female element in the uncouplable coupled position in absence of tension acting in a substantially transverse direction with respect to the coupling direction.

2. A press stud according to claim 1, wherein the elastic centring member is integral with the elastic engagement member.

3. A press stud according to claim 2, wherein the elastic centring member is annular and comprises an elastically deformable outer annular lip in contact with an inner cylindrical wall of the housing seat of the female element.

4. A press stud according to claim 1, wherein the coupling portion of the male element which is insertable into the housing seat of the female element has an anti-uncoupling appendage which interferes with the female element and prevents uncoupling of the male element from the female element in the locked coupled position.

5. A press stud according to claim 4, wherein the female element comprises an anti-uncoupling appendage which interacts with the anti-uncoupling appendage of the male element to prevent mutual uncoupling of the male element from the female element when the male element and the female element are subjected to tension acting in the substantially transverse direction with respect to the coupling direction.

6. A press stud according to claim 5, wherein the two anti-uncoupling appendages are annular and one has a smaller outside diameter than the other, so that one can be inserted into the other when they are kept substantially coaxial.

7. A press stud according to claim 6, wherein the anti-uncoupling appendage of the male element comprises an annular disc near a base of the male element, the anti-uncoupling appendage of the female element being an edge of the housing seat of the coupling portion of the male element, which is partially positioned in a space between the annular disc and the base of the male element as a result of tension acting in the substantially transverse direction with respect to the coupling direction.

8. A press stud according to claim 6, wherein the coupling portion of the male element which is insertable into the housing seat of the female element comprises a tubular end having an annular bent-back part bent inwards to form the anti-uncoupling appendage of the male element, the annular bent-back part being adapted to interfere with an outer annular bent-back part of a tubular body protruding from a base of the housing seat of the female element.

9. A press stud according to claim 1, wherein the coupling portion of the male element comprises a smooth end head joined to a narrower neck in which the elastic engagement member mounted in the female element engages in a disengageable way, so as to be deformed elastically by the smooth end head of the coupling portion of the male element when the coupling portion is inserted into the housing seat of the female element in the coupling direction.

* * * * *